US005081392A

United States Patent [19]

Alig

[11] Patent Number: 5,081,392

[45] Date of Patent: Jan. 14, 1992

[54] COLOR PICTURE TUBE HAVING AN INTERNAL MAGNETIC SHIELD

[75] Inventor: Roger C. Alig, Princeton Junction, N.J.

[73] Assignee: RCA Thomson Licensing Corporation, Princeton, N.J.

[21] Appl. No.: 580,687

[22] Filed: Sep. 11, 1990

[51] Int. Cl.[5] ..... H01J 29/06; H01J 29/94

[52] U.S. Cl. ..... 313/402; 313/407; 313/479

[58] Field of Search ..... 313/402, 407, 479, 313, 313/85; 174/35 MS

[56] References Cited

U.S. PATENT DOCUMENTS

| | | | |
|---|---|---|---|
| 3,867,668 | 2/1975 | Shrader | 315/8 |
| 4,019,085 | 4/1977 | Sakata | 313/402 |
| 4,229,674 | 10/1980 | Matsuki et al. | 315/85 |
| 4,513,221 | 4/1985 | Robbins | 315/85 |
| 4,580,076 | 4/1986 | Shimoma et al. | 313/402 |
| 4,622,490 | 11/1986 | Benway | 313/402 |
| 4,758,193 | 7/1988 | Brown | 445/1 |

FOREIGN PATENT DOCUMENTS

| | | | |
|---|---|---|---|
| 2363566 | 7/1974 | Netherlands | 313/402 |

*Primary Examiner*—Donald J. Yusko
*Assistant Examiner*—Nimeshkumar D. Patel
*Attorney, Agent, or Firm*—J. S. Tripoli; D. H. Irlbeck; L. L. Hallacher

[57] ABSTRACT

A color picture tube includes a faceplate and a funnel attached to the faceplate. The faceplate has a horizontal dimension $M_h$ and a vertical dimension $M_v$, with the dimensions having a ratio $M_h/M_v$ greater than one. A magnetic shield is located within the tube. The magnetic shield has a front aperture in the proximity of the faceplate and a rear aperture remote from the faceplate. The front aperture has a horizontal dimension $F_h$ and a vertical dimension $F_v$ and the rear aperture has a horizontal dimension $R_h$ and a vertical dimension $R_v$. The top and bottom of the rear aperature are close to the sides of the funnel and the sides of the rear aperture are spaced from the funnel by a spacing consistent with the entrance of the electron beams at maximum deflection into the shield.

8 Claims, 2 Drawing Sheets

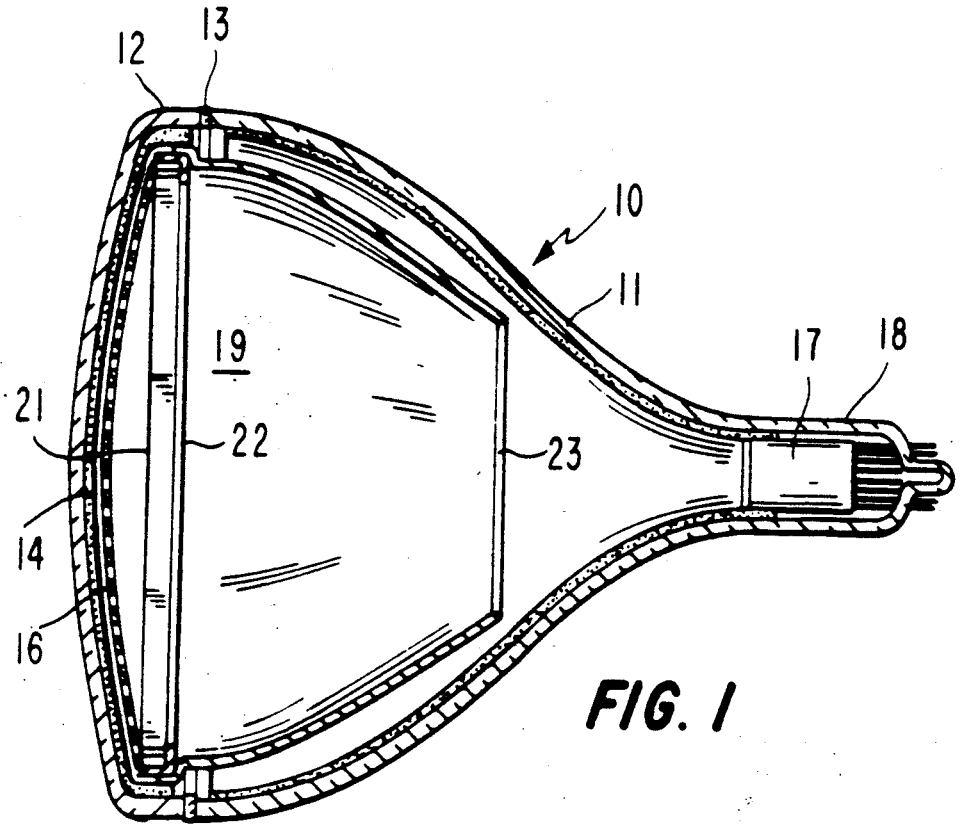
FIG. 1
FIG. 2
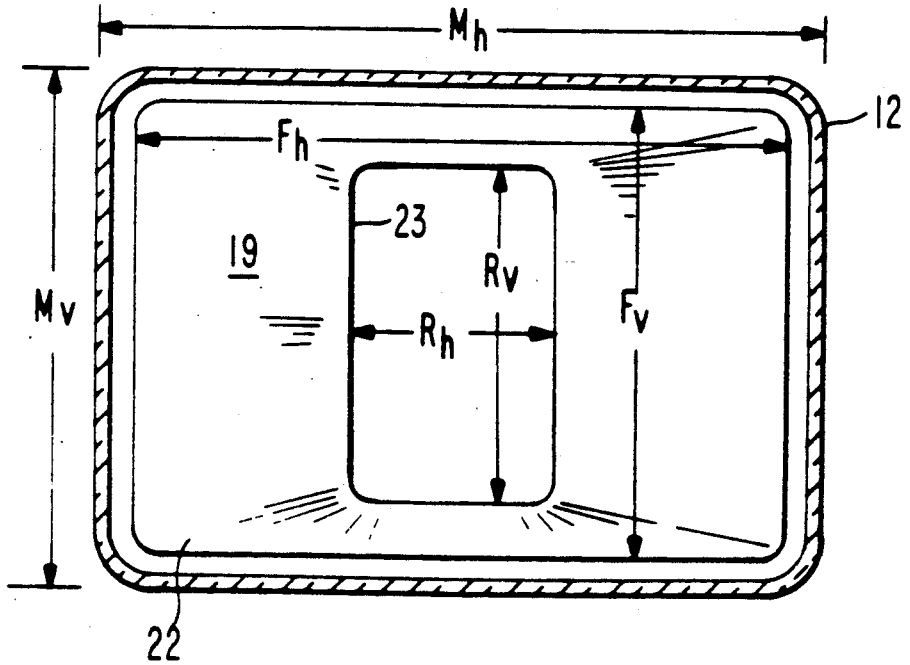

COLOR PICTURE TUBE HAVING AN INTERNAL MAGNETIC SHIELD

This invention relates to a color picture tube, and particularly to such a tube having an internal magnetic shield providing improved shielding in three magnetic fields.

BACKGROUND

A color picture tube includes a faceplate and a funnel which are integrally joined together. The inside surface of the faceplate is covered with a phosphor screen composed of triads of phosphor elements which emit the three primary colors of light, red, green and blue when impacted by electrons. An electron gun is mounted in a neck portion which is attached to the funnel in a position remote from the faceplate. The electron gun provides three electron beams which are used to scan the phosphor pixels to cause the desired image to be displayed. A shadow mask is arranged in the proximity of the phosphor screen and is used as a color selection electrode to assure that each of the three electron beams impacts the phosphor of the proper light emitting color. Thus, for example, the electron beam which is modulated with the red data impacts the phosphor pixels which emit red light. Because the electrons are charged particles, the Earth's magnetic field has an influence on their trajectories which can cause the electrons to impact a phosphor of the improper color, a phenomena known as misregistry. For this reason, a magnetic shield is commonly used, either in the interior or on the exterior, of the picture tube, to shield a substantial portion of the electron beam trajectories from the influence of the Earth's magnetic field. Most recent tubes utilize an interior magnetic shield (IMS) which is attached to the shadow mask and extends toward the electron gun.

The magnetic effect on electron beams, which causes misregistry, occurs in the directions which are perpendicular to the longitudinal axis of the tube. For this reason, various changes in the configuration, or structure, of the internal magnetic shield can beneficially influence the misregistration in one direction and adversely influence it in an orthogonal direction. Misregistry must be corrected in all three field directions: axial, horizontal, and vertical. The axial (north-south) field acts parallel to the longitudinal axis of the tube. The horizontal (east-west) and vertical fields act along the horizontal and vertical axes of the faceplate, respectively. In the early prior art, the vertical field was shielded from the interior of the tube by enclosing the interior of the tube as completely as possible. This entailed attaching an internal shield to the mask and minimizing the size of the opening facing the electron gun. In later prior art, the axial field was reshaped to have a vertical component by the formation of V-notches on the sides of the shield which enlarged the rear opening facing the electron gun but degraded the vertical-field shielding. Since the horizontal field is reshaped by the shadow mask, the shield generally interferes with this function by the shadow mask, the shield generally interferes with this function of the shadow mask. This interference is reduced in the prior art by placing vertical cuts in the shield to section it horizontally, e.g., by placing vertical slots along the minor axis of the shield. These cuts, or slots, further reduce the enclosure of the tube interior by the shield, thus further degrading the vertical-field shielding ability of the shield. Thus, the prior art is generally deficient in providing adequate shielding in all three fields. The present invention is directed to a tube having an internal magnetic shield which has a favorable influence on electron beam misregistry in all directions.

SUMMARY

A color picture tube includes a faceplate and a funnel attached to the faceplate. The faceplate has a horizontal dimension $M_h$ and a vertical dimension $M_v$, with the dimensions having a ratio $M_h/M_v$ greater than one. A magnetic shield is located within the tube. The magnetic shield has a front aperture in the proximity of the faceplate and a rear aperture remote from the faceplate. The front aperture has a horizontal dimension $F_h$ and a vertical dimension $F_v$ and the rear aperture has a horizontal dimension $R_h$ and a vertical dimension $R_v$. The top and bottom of the rear aperture are close to the sides of the funnel and the sides of the rear aperture are spaced from the funnel by a spacing consistent with the entrance of the electron beams at maximum deflection into the shield.

BRIEF DESCRIPTION OF THE DRAWINGS

FIG. 1 is a cross sectional view of a color picture tube including a novel internal magnetic shield.

FIG. 2 shows a preferred embodiment of the magnetic shield mounted in a faceplate.

DETAILED DESCRIPTION

Figure 3:
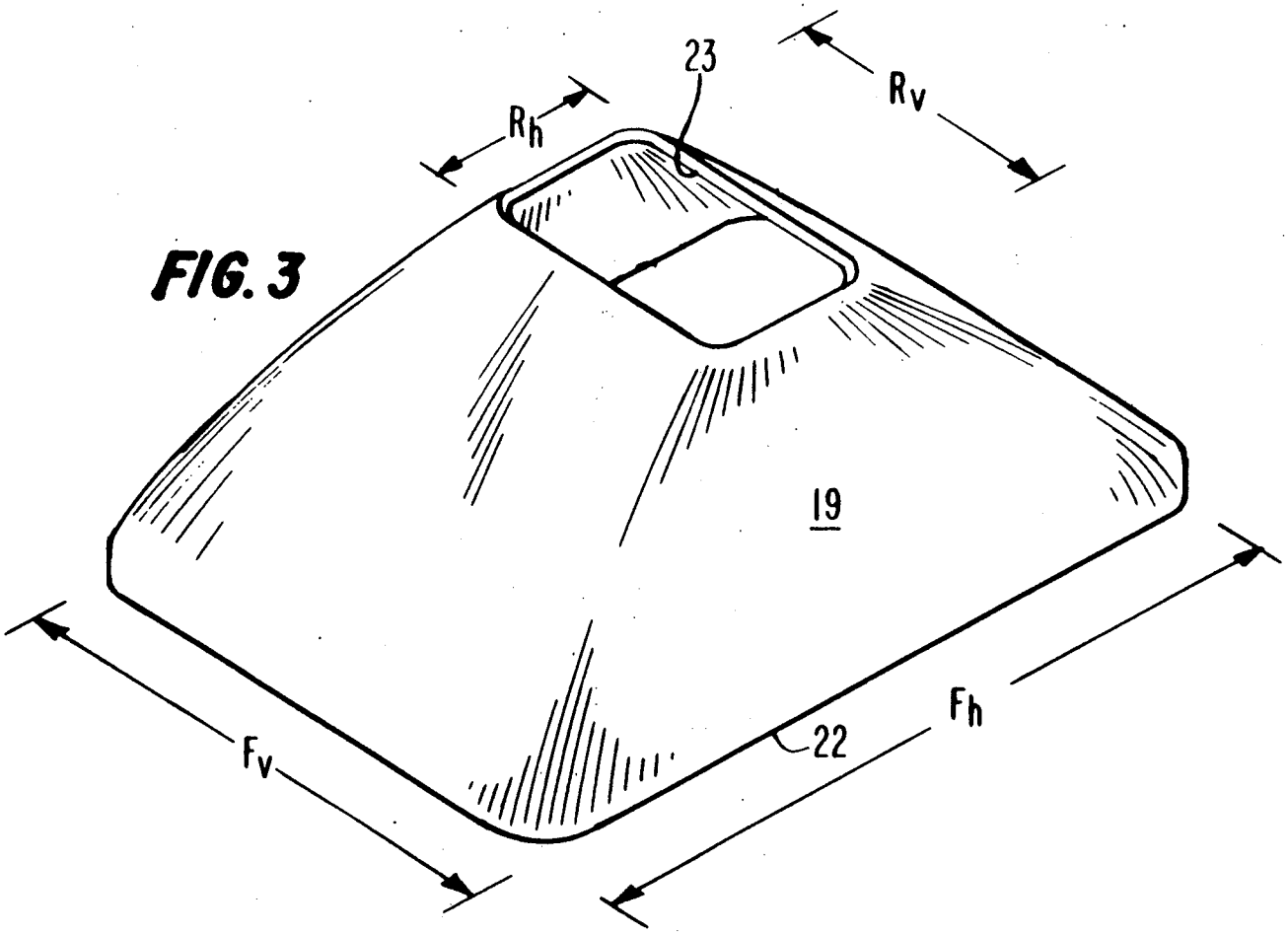
FIG. 3 is an isometric view of the preferred embodiment of the magnetic shield.

In FIG. 1, a color picture tube 10 includes a funnel 11 and a faceplate 12 which are integrally joined at a frit seal line 13. A phosphor screen 14 is arranged on the inside surface of the faceplate 12. The phosphor screen 14 is composed of triads of phosphors each of which emits one of the three primary colors of light when impacted by three electron beams. A shadow mask 16 is spaced from the phosphor screen 14 and is used to direct the three electron beams to the phosphors which emit the appropriate colors of light. An electron gun 17 is arranged in a neck portion 18 of the kinescope 10 and provides the three electron beams which are used to scan the phosphors of the screen 14.

The electrons are charged particles, and accordingly the electron beams are subject to deflection because of the influence of the Earth's magnetic field. The effects of the Earth's magnetic field are minimized by utilizing an interior magnetic shield 19. The shield 19 is composed of a ferromagnetic material, such as cold rolled steel, which bends or redirects the magnetic field lines of the Earth around the electron beams to minimize the effects on the beams as they pass through the shield. This is an important feature because the electron beam deflection caused by the Earth's magnetic field can cause a particular electron beam to hit a phosphor of the wrong light emitting color, thus resulting in misregistry and thereby degrading the quality of the image display. Additionally, when a television receiver including the tube is moved from one position to another, the relative position of the axis of the tube with respect to the Earth's magnetic field changes, thereby possibly causing substantial degradation of the image display because of additional misregistration of the electron beams.

In FIGS. 1 and 2, the magnetic shield 19 is supported on a shadow mask frame 21, which also is ferromagnetic, so that the two are magnetically coupled. The magnetic shield 19 includes a front aperture 22, arranged in the proximity of the faceplate 12, and a rear aperture 23, which is arranged remote from the faceplate 12 and faces the electron gun 17. The magnetic shield 19 lies within the interior surface of the funnel 11. The rear aperture 23 permits entry of the electron beams into the shield and must be large enough to accept all the beams. Between the front aperture 22 and the rear aperture 23, the shield must lie within the interior surface of the funnel 11 but not so far from the sides of the funnel that the shield intercepts the electron beams. Thus, the interior funnel surface and the surface of the space filled by the electron beams define a shell or gap in which no electrons flow.

In the prior art, a shield is placed in a tube so that the separation of the shield from the surfaces of the funnel are approximately the same at the sides of the shield as it is at the top and bottom of the shield. Such spacing minimizes problems associated with putting the shield into the funnel and also alleviates problems associated with the prior art shield intercepting the electron beams. In the novel shield 19, the top and bottom of the shield are made to lie close to the top and bottom of the funnel and the sides of the shield 19 are made to lie as far as possible from the sides of the funnel without intercepting the beams. Thus, because the funnel transforms from a horizontally rectangular to a vertically rectangular cross-section at a location in the proximity of the rear of the shield, the height of the shield will be greater than the width of the shield at that location. At the very rear of the shield 19, the width of the rear aperture 23 is only large enough to admit the electron beams and the height of aperture 23 exceeds the width of the aperture.

In FIG. 2, the faceplate 12 has a major horizontal dimension $M_h$ and a minor vertical dimension $M_v$. These dimensions are selected so that the aspect ratio $M_h/M_v$ is greater than one. In the proximity of the front aperture 22 the magnetic shield 19 is arranged within the faceplate 12, as shown in FIG. 2, and the front aperture 22 has a horizontal dimension $F_h$ and a vertical dimension $F_v$. In the vicinity of the front aperture 22, the magnetic shield 19 is configured very similarly to the configuration of the faceplate 12. Accordingly, the dimensions $F_h$ and $F_v$ of the front aperture 22 are selected so that the aspect ratio $F_h/F_v$ is greater than one. The rear aperture 23 is centered in the shield 19 and has a horizontal dimension $R_h$ and a vertical dimension $R_v$. When the shield 19 is properly arranged in the funnel 11 of the tube 10, the top and bottom of the funnel are substantially closer to the top and bottom of the rear aperture 23 than the sides of the funnel are to the sides of the aperture 23. The dimensions $R_h$ and $R_v$ of the aperture 23 are selected so that the aperture is no larger than is necessary for the entry of the deflected electron beams into the rear aperture 23. The dimensions $R_h$ and $R_v$ therefore preferably are selected so that the aspect ratio $R_h/R_v$ is less than one. A rear aperture 23 which is dimensioned in accordance with these criteria, or with an aspect ratio $R_h/R_v$ less than one, substantially decreases misregistry in a north magnetic field by shaping the field to have a large vertical component. Misregistry is decreased in the east-west field by presenting a flat magnetice field to the electron beams.

Utilizing the novel shield 19, the enclosure of the interior of the tube 10 is kept as complete as is compatible with the maximum deflection of the electron beams through the shield 19. The narrow rear aperture 23 reshapes the axial field to have a vertical component, thereby improving registry in much the same manner as the prior art shield with V-notches does. The shield 19 is also as high vertically as is compatible with the funnel interior, thereby further enhancing the redirection of the axial field to have a vertical component.

For horizontal fields, the shield would ideally be absent, so that the mask can reshape this field to have axial and vertical components. Given the presence of the shield, ideally such shield should be a flat plate in the minor axis plane, i.e., orthogonal to the horizontal field, since shield plates orthogonal to a field do not alter the field. Of course, a flat plate is not compatible with the transmission of electron beams. The best possible approximation is a box-like structure that has minimal width and maximal height. The shield 19, disclosed herein, provides such a structure.

What is claimed is:

1. In a color picture tube including a faceplate and a funnel attached to said faceplate, said faceplate having a horizontal faceplate dimension $M_h$ and a vertical faceplate dimension $M_v$, said dimensions having an aspect ratio, $M_h/M_v$, greater than one, said tube including a magnetic shield located within said tube, the improvement comprising:

said magnetic shield having a substantially rectangular front aperture in the proximity of said faceplate and including a horizontal dimension $F_h$ and a vertical dimension $F_v$, said front aperture dimensions having an aspect ratio, $F_h/F_v$, greater than one, said magnetic shield also having a substantially rectangular rear aperture remote from said faceplate and including a horizontal dimension $R_h$ and a vertical dimension $R_v$, said rear aperture dimensions having an aspect ratio, $R_h/R_v$, less than one.

2. The tube of claim 1 wherein said magnetic shield extends into said funnel, and wherein the top and bottom of said rear aperture are closer to said funnel than the sides of said rear aperture.

3. The tube of claim 1 wherein said faceplate and said front aperture have substantially the same configuration.

4. The tube of claim 2 wherein said faceplate and said front aperture have substantially the same configuration.

5. The tube of claim 1 wherein said front and rear apertures are centered on the longitudinal axis of said color picture tube.

6. The tube of claim 2 wherein said front and rear apertures are centered on the longitudinal axis of said color picture tube.

7. In a color picture tube including a substantially rectangular faceplate having a viewing screen thereon, a funnel attached to said faceplate and a magnetic shield located therein, the improvement comprising:

said magnetic shield including a substantially rectangular front aperture in the proximity of said screen and dimensioned whereby the sides, the top and the bottom of said front aperture are closely spaced from said funnel, and said magnetic shield including a substantially rectangular rear aperture arranged remote from said screen and dimensioned whereby the top and bottom of said rear aperture are closely spaced from said funnel, and the sides of said rear aperture are spaced from said funnel by the maximum distance which permits said electron beams to enter said shield at maximum deflection in the close proximity of the sides of said shield.

8. The tube of claim 7 wherein said faceplate has a horizontal faceplate dimension $M_h$ and a vertical faceplate dimension $M_v$, said dimensions having a ratio, $M_h/M_v$, greater than one, said front aperture having a horizontal dimension $F_h$ and a vertical dimension $F_v$ and having a ratio, $F_h/F_v$, greater than one, and said rear aperture having a horizontal dimension $R_h$ and a vertical dimension $R_v$ having a ratio, $R_h/R_v$, less than one.

* * * * *